US005176381A

United States Patent [19]

Winters

[11] Patent Number: 5,176,381

[45] Date of Patent: Jan. 5, 1993

[54] MATHEMATICAL GAME APPARATUS AND METHOD

[76] Inventor: Phil Winters, 3212 Northwest Ave., Suite C-317, Bellingham, Wash. 98225

[21] Appl. No.: 784,753

[22] Filed: Oct. 30, 1991

[51] Int. Cl.[5] ..... A63F 9/04

[52] U.S. Cl. ..... 273/146; 273/272; 434/208; 434/209

[58] Field of Search ..... 273/272, 196; 434/191, 434/197, 208, 209

[56] References Cited

U.S. PATENT DOCUMENTS

| | | | |
|---|---|---|---|
| 1,238,522 | 8/1917 | Kalista | 273/269 |
| 3,314,168 | 4/1967 | Heckman | 273/146 |
| 3,523,377 | 8/1970 | Gardner | 273/146 |
| 3,959,893 | 6/1976 | Sigg | 273/146 |
| 4,316,612 | 2/1982 | Harder | 273/272 |
| 4,410,182 | 10/1983 | Francis | 273/268 |
| 4,421,315 | 12/1983 | Cutler | 273/268 |
| 4,443,012 | 4/1984 | Makovic et al. | 273/292 |
| 4,452,588 | 6/1984 | Smith | 273/146 |

*Primary Examiner*—Benjamin H. Layno
*Attorney, Agent, or Firm*—Hughes & Multer

[57] ABSTRACT

A method of playing a game where there is a first set of die, each of which has the numerical values of one through six thereon, and a second set of die each of which has plus, minus, division and multiplication signs thereon. The two sets of die are discharged onto a playing surface in a random pattern, and then the individual dice members of the first and second set are placed in an alternating pattern so that when the mathematical operations are performed as indicated in the alternating arrangement of the two sets of die, a desired maximum value is obtained.

5 Claims, 2 Drawing Sheets

MATHEMATICAL GAME APPARATUS AND METHOD

The present invention relates to a game apparatus and method where randomly selected numerical values are arranged with randomly selected mathematically related operational symbols, in a manner that calculations are made using the numerical values in accordance with the operational symbols displayed to arrive at a calculated numerical value, and more particularly to a game method and apparatus where there are first and second sets of dice means to display said numerical values and operational symbols which are selectively arranged by the player in a required framework of an alternating pattern so that the calculated value is as close as possible to a targeted mathematical value.

BACKGROUND ART

There are in the prior art games which utilize dice or the like to provide a first set of randomly selected numerical values and also a second set of mathematical operational symbols which are utilized in conjunction with one another to achieve a desired result. Two such games were disclosed in a search of the U.S. patent literature, these being the following:

U.S. Pat. No. 3,523,377 (Gardner) discloses an instructional game where there are two sets of dice. Each die of the first set has a series of numbers, each of which is placed on one of the six spaces of that dice. Each die of the second set has on four of its six faces mathematical operational symbols, namely a plus sign, a minus sign, a multiplication sign, and a division sign, and on the other two faces equals sign. The game is played by rolling the two sets of dice and then arranging these so that a mathematically correct equation is displayed. Thus, the result achieved by arranging the numerical values and mathematical symbols is to achieve a balanced equation.

U.S. Pat. No. 3,314,168 (Heckman) shows a game where there are two sets of dice, one of which has numerical values on each face of each die, and the other set having mathematical operational symbols on four of the six faces of each die, namely a minus sign, a plus sign, a multiplication sign and a division sign. There is also a set of cards having a numerical value thereon. The game is played by turning over a card to display a numerical value, rolling the two sets of dice, and then attempting to arrange the numerical values with the mathematical operation symbols so that the numerical equivalent of the numbers along with the mathematical operational symbols equals the number on the card. Therefore the result achieved by performing the basic operation of this game is to arrange the numerical values with the operational symbols in a manner to achieve a value equal to a randomly selected value as indicated on one of the selected cards.

Other patents disclosed in the search are the following.

U.S. Pat. No. 4,421,315 (Cutler) shows a game where there are a plurality of pivotally mounted panels which have numerical values on one face and letters on the other face. A pair of dice are rolled to provide the numbers for a total numerical value (e.g. the value three on one die and the numerical value six on another die totaling nine). Then two panels are moved down, the numerical values of which would add up to the same total (e.g. nine). Then the player attempts to create words from the letters displayed on those panels that have been moved downwardly.

U.S. Pat. No. 4,316,612 (Harder) shows an educational algebra board game where there is a game board and a plurality of "equation strips", each of which has printed thereon an equation or inequality to be solved. There is also a plurality of markers having printed thereon portions of the equations or inequalities. The player then places the portions of the equations (i.e. the markers) on the equation strips to properly form the equation or inequality.

U.S. Pat. No. 1,238,522 (Kalista) shows a game where there are displayed a series of numbers ranging from 2 to 12. A pair of dice are rolled, and the numerical value of the sum of the two die is covered on the particular numerical display of that same value. The object of the game is to roll the dice until the person has managed to cover up all of his or her particular numbers.

U.S. Pat. No. 4,443,012 (Makovic et al) discloses a combination card and dice game where there is a set of playing cards, each of which has printed thereon the symbols for each possible combination of a pair of dice to make that numerical value. For example, the cards corresponding to the numerical value 3 have printed thereon one die displaying a single dot and the other die displaying 2 dots for a total of 3. Then the roll of the dice is correlated with the cards and the playing of the game.

U.S. Pat. No. 4,410,182 (Francis) discloses what is called an "arithmetic dice game board". There are eleven elements 30 mounted rotatably on a rod, so that each element can be moved to a one position where a number thereon is displayed, and then moved to a second position where the number is covered or masked. The pair of dice are rolled and the total shown on the two dice permits the player to move two numbers on the elements that total the total value shown on the dice. For example, if the dice display a total of 8, by the two dice showing a 6 plus 2 value, the player can mask the number 8, or the numbers 7 and 1, the numbers 6 and 2, etc.

SUMMARY OF THE INVENTION

The game of the present invention is designed to utilize the mathematical skills of the players in performing basis arithmetical operations. Also, it is designed to maintain a relatively high level of interest throughout the game.

In the method of the present invention, the game is played by the player first deploying a plurality of first dice means, each of which has a plurality of numerical values associated therewith. This is done so that one of the numerical values of each first dice means is randomly presented, with the results being the various combinations of said numerical values being presented at random.

In like manner, a plurality of second dice means deployed, each of these second dice means having a plurality of mathematically related operational symbols associated therewith. This is done in the manner that one of the operational symbols of each second dice means is randomly presented so that various combinations of the operational symbols are presented at random.

The first and second dice means are then selectively placed in a selected arrangement in a required format of an alternating pattern where the first dice means are interspersed with a second dice means, in a manner that a calculated numerical value is achieved by performing the mathematical operations indicated on the operational symbols presented with the adjacent numerical values presented.

The first and second dice means are placed in a manner that the calculated numerical value approaches as closely the target numerical value.

In the preferred embodiment, the target numerical value is a maximum absolute numerical value, and more preferably the target mathematical value is a positive mathematical value. As an alternative, the maximum absolute value is a negative absolute value.

In a modification of the game, the target mathematical value can be an intermediate value which lies within a range of the calculated numerical values having a reasonable probability of being achieved in a normal course of deploying and arranging the first and second dice means in playing the game.

The game is played so that the required format is such that a minimum quantity of the first and second dice means must be presented in the selected arrangement. More preferably all of the first and second dice means must be placed in the selected arrangement.

Also, in the preferred form, each adjacent pair of first dice means in the selected arrangement has positioned therebetween a single presented operational symbol of one of the second dice means.

Other features of the present invention will become apparent from the following detailed description.

DESCRIPTION OF THE PREFERRED EMBODIMENTS

It is believed that a clearer understanding of the present invention will be obtained by describing in order:

a. The basic components of the game of the present invention;

b. The manner in which a single "turn" of a player is accomplished in the preferred embodiment;

c. The overall procedure in accomplishing a single game in accordance with the preferred first embodiment;

d. Alternative embodiments of the present invention e. Other aspects of the present invention.

a. Basic Game Components

There are four main components of the game of the present invention, namely a first set of dice 10 having numerical designations thereon; a second set of dice 12 having thereon symbols designating mathematical operations; a timer 14; and a tabulating/score sheet 16.

Figure 1:
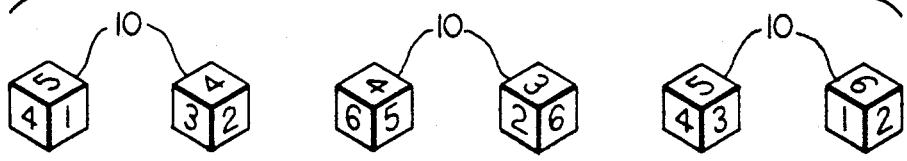
FIG. 1 is an isometric view of a first set of dice means used in the present invention, these displaying numerical values on each face of each dice means.

As shown in FIG. 1, the first set of dice 10 comprises in this preferred embodiment six separate six-sided cube shaped dice 18, having the numerals 1 through 6, each imprinted on a respective one of the six faces of each die 10. Thus, it is apparent that this first set of dice can comprise six conventional dice commonly used in a variety of games.

Figure 2:
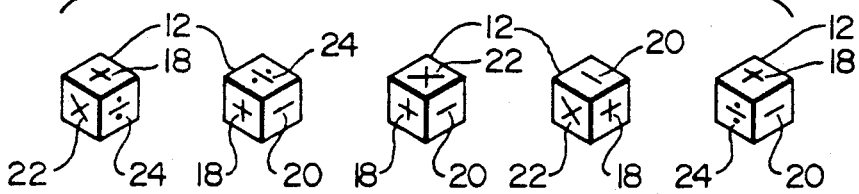
FIG. 2 is an isometric view showing a second set of dice means, each of which has displayed thereon mathematical operational symbols, such as a plus sign, etc.

Also in the preferred embodiment, the second set of dice 12 are each a cube shaped die having six sides, with a mathematical operating symbol imprinted on each of the six surfaces of each die 12. In this preferred embodiment, as shown in FIG. 2, four mathematical symbols are displayed, namely three plus signs 18, each on one three faces, one minus sign 20 on one face, one multiplication sign 2 on one face, and one division sign 24 on one face. Thus, the probabilities are that in any one throw of a single die, fifty percent of the time the plus sign will be displayed on the uppermost surface, while the probability of any one of the other three symbols appearing on the uppermost surface is one out of six. Desirably, the first set of dice 10 has a different color or is otherwise distinguished from the second set of dice 12.

Figure 3:
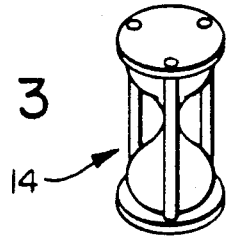
FIG. 3 is an isometric view of a timer used in the present invention.

The timer 14 is, as shown in FIG. 3, a simple hourglass timer where contained particles (e.g. sand) flow from one chamber through a restriction into a second chamber. Obviously, other timing devices could be used and a variable timing device could also be used, particularly for playing variations of the basic game.

Figure 4:
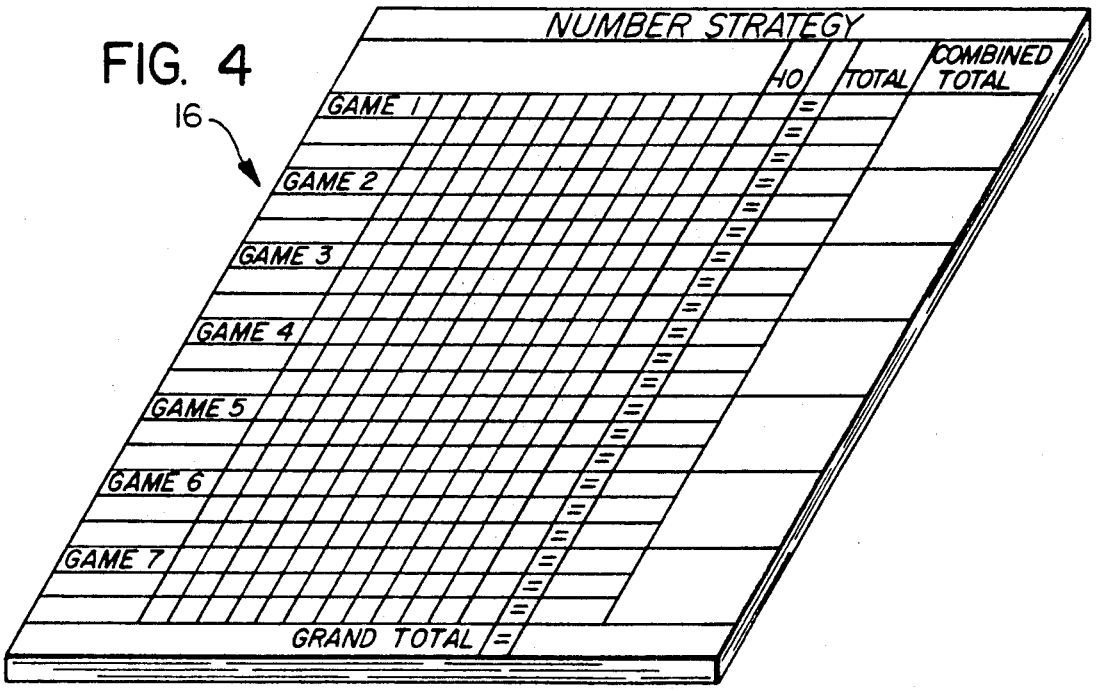
FIG. 4 is an isometric view of a pad of score sheets used in the present invention.

The score sheet 16 (shown in FIG. 4) has printed thereon eleven vertical columns in which a single numerical value or mathematical symbol is placed, a twelfth column which is penalty column, a thirteenth column containing equal signs, a fourteenth column where numerical totals are placed, and a fifteenth column where combined totals are placed. There are also horizontal rows, grouped in three sets of five, with the uppermost set of three rows being for a first game, the second set for a second game, and on down to a fifth game for the final three rows.

b. The Manner in Which a Single "Turn" of a Player is Accomplished in the Preferred Embodiment In this particular preferred embodiment, the purpose is to arrange the numbers that appear on the six first numerical dice 10 in an alternating pattern with the symbols displayed on the second mathematical symbol dice 12 so that the highest calculated absolute numerical value is obtained (which in this instance is a position value).

Figure 5:
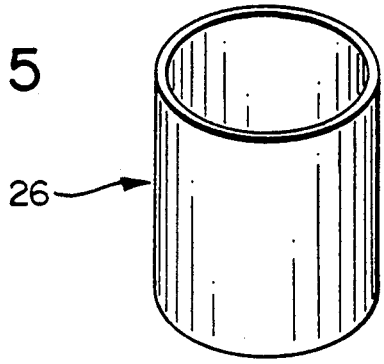
FIG. 5 is a dice cup from which the dice can be thrown onto a playing surface.
Figure 6:
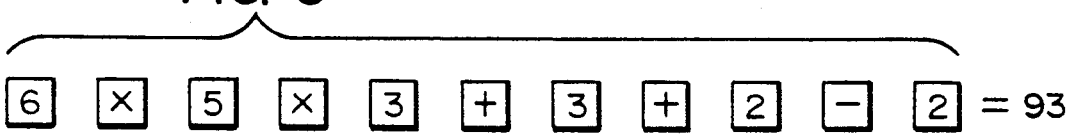
FIGS. 6 and 7 are two displays showing examples of arrangements of the first and second dice means that could be achieved in the course of playing a game.

To start a single turn, a player will place all eleven dice 10 and 12 in a suitable cup 26 (which is shown in FIG. 5 and is provided for convenience in the operation of throwing the dice), and then the eleven dice 10 and 12 are discharged from the cup 26 onto a table surface. Let it be assumed that the dice 10 and 12 fall on the table surface in a random pattern where, as shown in FIG. 6, the six first numerical dice have:

a. two "2's"

b. two "3's"

c. one "5"

d. one "6"

Let it be assumed that the second mathematical operational dice 12 are as follows:

a. two "plus" signs b. two "multiplication" signs c. one "minus" sign

As indicated above, in this particular embodiment it is the object of the game to arrange the numerical dice 10 in an alternating pattern with the mathematical symbol dice 12 to maximize the calculated numerical value. In this particular instance, the player would arrange the dice in the following sequence, as shown in FIG. 6, to obtain a maximum value. (For convenience, this same pattern is repeated in this text as follows: 6 times 5 times 3 plus 3 plus 2 minus 2 equals 93.

In making these calculations, first the multiplication and division is accomplished proceeding from left to right in the horizontal row of numbers, and then the addition and subtraction is accomplished in sequence by proceeding from left to right. In this particular instance, there is first the calculation of 6 times 5 times 3 which gives a total of 90. Then the fourth and fifth numbers are added (namely the 3 and the 2) to make total of 95, after which the final 2 in the row is subtracted to leave a total of 93.

As soon as the person completes arranging the eleven dice 10 and 12, then the dice values are recorded across the uppermost available row on the score sheet.

c. Describing the Overall Procedure in Accomplishing a Single Game in Accordance with the Preferred First Embodiment As indicated above, the object of this first embodiment of the game is to obtain the highest score possible by arranging the dice in each throw to obtain the highest calculated values in the time allowed.

To begin the game, each player receives a score sheet 16. the first player places all eleven dice in the shaker cup 26 and then throws all eleven dice 10 and 12 onto the table surface. At the same time, the timer 16 is turned over so that all of the sand is in the upper chamber so as to begin the timing sequence. Then the player immediately begins arranging the first numerical dice 10 in an alternating pattern with the mathematical symbol dice 12 so that these are in a single row. Immediately after arranging these dice in a row, the player then writes the numerical or mathematical symbol of each dice in the uppermost row across the score sheet.

Then the player immediately places the dice back into the cup 26, tosses the dice onto the table, and then again begins arranging the dice 10 and 12 in accordance with the procedure outlines above. The timer 14 is, in this preferred embodiment, arranged to run out after exactly one three turns (i.e. three sequences of throwing and arranging the dice 10 and 12) for each one minute timing interval. If the player is able to complete the third turn by arranging the eleven dice in a row in the one minute time limit, but is not able to record that third turn on the sheet 16 within the one minute time limit, then the player is allowed to go over the one minute time limit simply for writing down the numbers and mathematical symbols that appear in the row of dice at the completion of the third term. However, as will be described later a penalty is imposed.

During the one minute time interval while the person is throwing the dice, rearranging these in a row and then writing down the numbers and symbols, it is not necessary to calculate the resulting score for each turn. After the three turns or less of the player are completed, then these can be calculated.

When one player has completed his three allotted turns (or completed what he can in the allotted period of time), then the cup 26 and the dice 10 and 12 are passed on to the next player, so that the next player can then complete his or her three turns.

Certain penalties can be assessed. First, as indicated above, if on any one of the three throws the time has expired but the player has the dice arranged in a row, but not written the information completely on the score sheet 16, the player can finish writing the sequence down on the score sheet, but he must subtract a penalty of ten points from the total.

Also, in accordance with the rules, it is required that the calculated number should not contain a fraction. If a fraction does appear in the calculated results of one turn, then the fraction can be counted, but ten points are subtracted from the total score for that turn.

Further, a penalty of minus ten for a game is assessed if the player incorrectly adds the total scores.

A variety of other penalty points are assessed in this preferred embodiment, these being the following:

1. If the time expires before the dice are arranged in that turn;
2. If the dice are placed in the wrong order (e.g. two numerical or two symbol die in a row);
3. If the player writes down the symbols and numbers differently from the way they are arranged in the row during play;
4. If the player incorrectly adds the numbers for the row.

A single game is completed when each player has had the opportunity to try to complete his or her three turns within the one minute time limit. The score sheet is arranged so that five games can be played with each player using a single score sheet 16.

Also, in some instances a player will throw the dice 10 and 12 on a single turn and recognize immediately that it is a very bad throw. For example, in an extreme case, the player may have as many as four or five subtraction and/or division operating symbols, so that the numerical value would be very low (or even a minus quantity) or would have a fraction in the calculated value which of course mean a minus 10 penalty. Under these circumstances, the player may simply "scratch" that turn and take a ten point penalty. Then if that "scratched" turn is the first or second turn, the player would have more time to complete the third turn (or the second and third turn if the first turn is "scratched") and hopefully come up with a better score.

d. Alternative Arrangements in Embodiments of the Present Invention

The preferred embodiment is described above, but other arrangements are possible. For example, if using the timer with the three turns is found to be too competitive under some circumstances, the rules could be modified to what might be called the "family version". For example, the players could ignore the normal mathematical rules that would apply (where the multiplication and division is accomplished first, after which the addition and subtraction is accomplished with these values). Under these circumstances, the calculation could proceed simply by performing each mathematical operation in sequence going from left to right, as shown in the following example.

3 times 2 plus 2 times 3 plus 2 minus 1=25

It is evident that if the first described method is used so that the multiplication is accomplished first, after which the addition is accomplished, the calculated value would be only thirteen, Also, it is evident that the numbers are not arranged in the optimized order to maximize the calculated value. A preferred order would be the following:

1. 2 plus 2 plus 2 times 3 times 3 minus 1=53 (assuming that the mathematical operations are carried in straight sequence beginning from left to right) or 2. 3 times 3 times 2 plus 2 plus 2 minus 1=21 (assuming that the multiplication and addition are done first, after which the values are added or subtracted).

Further, as noted above, in the preferred first embodiment, the object of the game is to maximize the calculated positive numerical value on each turn. It is evident that a variation of this would be to maximize the absolute negative values so that the player would attempt to obtain a minus score of maximum negative value, if possible (or at least as low a positive score as possible).

Yet a further modification of this would be that the player would execute the turn so that the target would be to have as low a net value as possible (i.e. where the total score would be as close to zero as possible).

These variations can be illustrated by examining the following situation.

Figure 7:
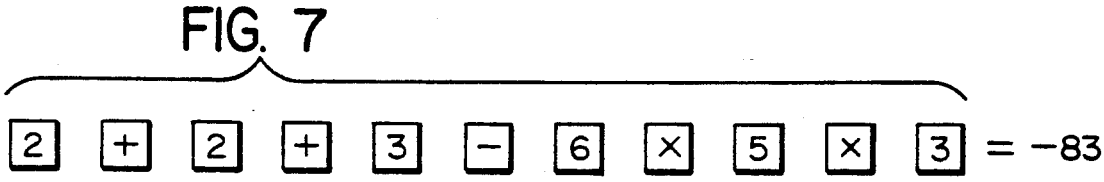

Let it be assumed that we have the same numbers and mathematical symbols, but that the game is played in a manner to obtain the lowest possible score, and preferably as far into the "minus" range as possible. Under this circumstance, the same numerical values and symbols in FIG. 7 could be arranged in the following manner:

2 plus 2 plus 3 minus 6 times 5 times 3=−83

Now let us take this same situation of numerical values and mathematical symbols as illustrated in FIG. 2, but it is desired to arrange these in a manner so that the calculated value approaches as closely as possibly a zero value. One method of arranging these same numbers and symbols would be as follows:

5 times 2 plus 3 plus 2 minus 6 times 3=−3

Another arrangement of these same numbers and symbols where the player can get even closer to zero, is as follows:

5 times 3 plus 2 plus 2 minus 6 times 3=1

It is evident, of course, that while in the present preferred embodiments, dice are utilized to provide the random selection of numerical values and symbols, other means could be used, and the terms "dice means", as used in the appended claims, is intended to reflect this. For example, random numerical values could be displayed by providing numerals on a series of disks which are rotatably mounted so that these could be spun to stop at a random location (in the manner in which numbers or symbols appear in a slot machine). Also, the numbers and mathematical symbols could be provided through some computerized means where the "throwing" of the dice is accomplished through a random generation of a computer, and possibly the actual rearrangement of the numerical and operational symbols could be accomplished through the computer.

e. Other Aspects of the Present Invention

It has been found that a desirable balance between the elements of chance and skill can be obtained where the mathematical symbol dice 12 are arranged with a greater number of plus symbols relative to the other symbols. Alternatively, a desirable balance could be obtained by having a disproportionately larger share of plus and minus symbols relative to the multiplication and division symbols. Thus, in the preferred form there are three addition symbols 18 on three surfaces of each of the second set of dice 12, while there is only one of each of the other symbols (i.e. the subtraction symbol 20, the multiplication symbol 22 and the division symbol 24). An alternative and yet an acceptable arrangement would be where there would be two addition symbols 18 and two subtraction symbols 20.

To give an example, in one sampling of performing twenty throws in a row (i.e. twenty throwing and arranging of the dice), and playing in accordance with the first preferred embodiment, the scores ranged from a low of 10 to a maximum of about 55. However, as the play continued for about an hour, there was one throw where the numerals 6 appeared twice and the numerals 5 appeared twice, and also three multiplication symbols appeared on the dice 12. By arranging these in the proper sequence so the two 6 numerals and the two 5 numerals were all multiplied, and then adding the remaining 1 numeral and 2 numeral, the grand total was 903 for one turn, as illustrated below.

6 times 6 times 5 times 5 plus 2 plus 1=903

To carry this analysis further, in the rather improbable situation where all six of the numeral dice 10 show up with the 6 number, and all five of the mathematical symbol dice 12 turn up with the multiplication sign, the calculated value would be six to the sixth power which would give a calculated value of 46,656.

It becomes apparent from this that at least in the preferred first embodiment where the object of the game is to maximize the score, no one player, even though very far behind in a sequence of games, is ever totally "out of the game", except in a very highly improbable situation.

To comment further on these aspects of the present invention, there are a number of challenges facing a person who is creating a game that is based in large part upon mathematical computations. First, the format of play would desirably be organized to provide a variety of computational operations to accomplish educational objectives. Second, it is desirable that on top of teaching or refining the basic computational skills, there be taught certain underlying mathematical relationships, depending upon how the computations are manipulated. Third, (and this can be the downfall of many games which would otherwise possibly be promising), there must be the elimination of the onset of boredom. To state this more positively, the game should be arranged so that it can provide the stimulus or excitement that entices a player to press on, even thought the game has been going badly at the early stages.

The game of the present invention is arranged so that each playing sequence is of itself a challenge, even if the player has a very unfortunate throw of the dice. Further, to sustain the interest through a run of bad luck in a long series of mediocre or bad throws of the dice, there should be that "end of the rainbow" where the player is never totally "out of game". The present invention uniquely satisfies these requirements.

It is evident that various other changes could be made without departing from the basic teachings of the present invention.

What is claimed:

1. A method of playing a game, comprising:

a. deploying a plurality of first dice means, each of which has a plurality of numerical values associated therewith, so that one of said numerical values of each first dice means is randomly presented so that various combinations of said numerical values are presented at random;

b. deploying a plurality of second dice means, each of which has a plurality of mathematically related operational symbols associated therewith, so that one of said operational symbols of each second dice means is randomly presented so that various combinations of said operational symbols are presented at random;

c. selectively placing said first and second dice means in a selected arrangement in a required format of an alternating pattern where the first dice means are interspersed with the second dice means, in a manner that a calculated numerical value is achieved by performing the mathematical operations indicated on the operational symbols presented with the adjacent numerical values presented;

d. said first and second dice means being played in a manner that the calculated numerical value approaches as closely as possible a target mathematical value; and e. said required format being such that a minimum quantity of said first and second dice means must be presented in said selected arrangement.

2. The method as recited in claim 1, wherein all of said first and second dice means must be placed in said selected arrangement.

3. The method as recited in claim 2, wherein said required format is such that each adjacent pair of first dice means in said selected arrangement has positioned therebetween a single presented operational symbol of one of said second dice means.

4. The method as recited in claim 1, wherein said required format is such that each adjacent pair of first dice means in said selected arrangement has positioned therebetween a single presented operational symbol of one of said second dice means.

5. A method of playing a game, comprising:

a. deploying a plurality of first dice means, each of which has a plurality of numerical values associated therewith, so that one of said numerical values of each first dice means is randomly presented so that various combinations of said numerical values are presented at random;

b. deploying a plurality of second dice means, each of which has a plurality of mathematically related operational symbols associated therewith, so that one of said operational symbols of each second dice means is randomly presented so that various combinations of said operational symbols are presented at random;

c. selectively placing said first and second dice means in a selected arrangement in a required format of an alternating pattern where the first dice means are interspersed with the second dice means, in a manner that a calculated numerical value is achieved by performing the mathematical operations indicated on the operational symbols presented with the adjacent numerical values presented; and d. said first and second dice means being played in a manner that the calculated numerical value approaches as closely as possible a target mathematical value, which is a maximum negative absolute numerical value.

* * * * *